US007988602B1

(12) United States Patent
Janzen

(10) Patent No.: US 7,988,602 B1
(45) Date of Patent: Aug. 2, 2011

(54) METHOD AND APPARATUS FOR TREATING PLANTAR FASCIITIS

(76) Inventor: Michael L. Janzen, Wichita, KS (US)

( * ) Notice: Subject to any disclaimer, the term of this patent is extended or adjusted under 35 U.S.C. 154(b) by 0 days.

(21) Appl. No.: 12/695,057

(22) Filed: Jan. 27, 2010

(51) Int. Cl.
*A63B 21/00* (2006.01)

(52) U.S. Cl. ..... 482/79; 482/907; 482/148

(58) Field of Classification Search ..... 482/907, 482/148, 79; D6/601; 292/342, 343; 188/32; 16/82; 49/70
See application file for complete search history.

(56) References Cited

U.S. PATENT DOCUMENTS

| | | | | |
|---|---|---|---|---|
| 1,939,402 | A * | 12/1933 | Moser | 292/343 |
| 4,660,323 | A * | 4/1987 | Kanies | 49/70 |
| 4,911,270 | A * | 3/1990 | Hudson | 188/32 |
| D405,135 | S | 2/1999 | Scott | |
| 5,865,779 | A | 2/1999 | Gleason | |
| 6,041,473 | A * | 3/2000 | Johnson | 16/82 |
| 6,170,176 | B1 | 1/2001 | Clough | |
| 6,699,209 | B2 | 3/2004 | Turtzo | |
| 6,938,363 | B1 | 9/2005 | Clough | |
| D517,347 | S * | 3/2006 | Hamilton et al. | D6/449 |
| 7,011,612 | B2 | 3/2006 | Repking | |
| D552,838 | S | 10/2007 | Quinn | |
| 7,396,338 | B2 | 7/2008 | Huber et al. | |
| 2004/0255488 | A1 | 12/2004 | Brooks | |
| 2007/0204487 | A1 | 9/2007 | Clough | |
| 2009/0113759 | A1 | 5/2009 | Heid | |
| 2009/0192427 | A1 | 7/2009 | Brown et al. | |
| 2009/0192428 | A1 | 7/2009 | DeBoer et al. | |

FOREIGN PATENT DOCUMENTS

| | | |
|---|---|---|
| JP | 19970120039 | 10/1998 |
| WO | 2006US018708 | 1/2007 |

OTHER PUBLICATIONS

"Healwell Club Plantar Fasciitis Resting Comfort Slipper," DocOrtho.com, 3 pages printed from the Internet on Aug. 30, 2009.

* cited by examiner

*Primary Examiner* — Jerome W Donnelly
(74) *Attorney, Agent, or Firm* — Jeffrey L. Thompson; Thompson & Thompson, P.A.

(57) ABSTRACT

A device and method for treating and preventing plantar fasciitis includes a wedge adapted to be placed under the big toe. The wedge has a top surface for supporting the big toe, a first support surface separated from the top surface by a first angle, and a second support separated from the top surface by a second angle. The first and second support surfaces are perpendicular with each other so that one rests on the floor and the other serves as a backstop. The wedge has a first position for inclining the top surface upwardly at the first angle to provide moderate stretching of the plantar fascia, and a second position for inclining the top surface upwardly at the second angle to provide maximum stretching. The first angle is within a range of 20 to 25 degrees, and the second angle is within a range of 65 to 70 degrees.

5 Claims, 3 Drawing Sheets

METHOD AND APPARATUS FOR TREATING PLANTAR FASCIITIS

BACKGROUND OF THE INVENTION

1. Field of the Invention

The present invention relates generally to orthotic devices and methods, and in particular, to orthotic devices and methods for treating and preventing plantar fasciitis.

2. Description of the Related Art

The plantar fascia is a highly elastic connective tissue located at the bottom of the human foot. The plantar fascia is attached at the front of the foot to the metatarsophalangeal joints and at the rear of the foot to the calcaneal (heel bone). The plantar fascia functions like a spring to absorb the shock of forces developed during walking and running.

Plantar fasciitis is a common foot problem experienced by athletes and others who engage in high impact activities that overstress the plantar fascia. For example, runners often experience plantar fasciitis. Overstress causes a loss of the natural elasticity in the plantar fascia tissue. The physical symptoms of plantar fasciitis include tenderness and swelling of the foot, and the condition often prevents the person from continuing with the high impact activity.

A number of treatment methods have been used in the prior art for treating plantar fasciitis. For example, U.S. Pat. No. 5,865,779 issued to Gleason discloses an orthotic device for treating plantar fasciitis that uses an enveloping sock with an insert to provide compressive forces on the foot to reduce or relieve stresses on the plantar fascia.

U.S. Pat. No. 6,170,176 issued to Clough discloses an orthopedic shoe appliance that includes a shoe pad with a wedge located in the area where the big toe rests on the pad. The wedge is used to elevate the big toe relative to the other toes on the foot to improve the stability of the foot structure during ambulation.

U.S. Pat. No. 6,938,363 issued to Clough discloses an orthopedic shoe appliance that includes a wedge for elevating the big toe. The wedge can be attached to the sole of a shoe, or it can be attached to the big toe directly for use without footwear. The wedge is used to limit the mobility of the medial arch area of the foot during ambulation to improve the stability of the foot structure.

There is a need for an improved orthotic apparatus and method for stretching the plantar fascia to treat and prevent plantar fasciitis.

SUMMARY OF THE INVENTION

An object of the present invention is to provide an orthotic apparatus and method for effectively treating and preventing plantar fasciitis.

A further object of the present invention is to provide a plantar fasciitis treatment apparatus and method that does not require footwear modification or use of an insert during walking or running activities.

A further object of the present invention is to provide a plantar fasciitis treatment apparatus that is compact, portable, easy to use, and provides multiple stretching positions to accommodate different foot conditions.

To accomplish these and other objects of the present invention, the Applicant has developed a device and method for treating and preventing plantar fasciitis that uses a wedge adapted to be placed under the big toe. The wedge has a top surface for supporting the big toe, a first support surface separated from the top surface by a first angle, and a second support separated from the top surface by a second angle. The first and second support surfaces are perpendicular with each other so that one rests on the floor and the other serves as a backstop for engaging a stationary object. The wedge has a first treatment position for inclining the top surface upwardly at the first angle to provide moderate stretching of the plantar fascia, and a second treatment position for inclining the top surface upwardly at the second angle to provide maximum stretching of the plantar fascia. The first angle is preferably within a range of 20 to 25 degrees, and the second angle is within a range of 65 to 70 degrees.

According to one aspect of the invention, a device for treating and preventing plantar fasciitis is provided, comprising: a wedge adapted to be placed under the phalanges of a user's big toe, the wedge having a top surface adapted to support the big toe, a first support surface separated from the top surface by a first angle, and a second support surface separated from the top surface by a second angle, the second angle being different from the first angle; the wedge having a first position with the first support surface facing downwardly for inclining the top surface upwardly at the first angle to provide moderate stretching of the plantar fascia; and the wedge having a second position with the second support surface facing downwardly for inclining the top surface upwardly at the second angle to provide maximum stretching of the plantar fascia.

According to another aspect of the invention, a device for treating and preventing plantar fasciitis is provided, comprising: a wedge adapted to be placed under the phalanges of a user's big toe, the wedge having a top surface on which the big toe rests during use, and first and second support surfaces, the second support surface being adapted to face downwardly and rest on a floor during use; and the wedge having an angle between the top surface and the second support surface that provides an angle of inclination of the proximal phalanx of the big toe relative to the first metatarsal thereof within a range of 65 to 70 degrees during use.

According to another aspect of the invention, a method of treating and preventing plantar fasciitis is provided, comprising: providing a wedge having a top surface, a first support surface separated from the top surface by a first angle, and a second support surface separated from the top surface by a second angle, the second support surface being perpendicular to the first support surface; placing the wedge on a floor with the first support surface facing downwardly and resting on the floor and the second support surface engaging a stationary object; placing a user's big toe against the top surface while lifting the user's foot slightly above the floor; lowering the user's foot while sliding the big toe down the top surface of the wedge until the foot is resting on the floor from about the ball of the foot back to the heel; and holding the foot in position with the big toe inclined by the wedge for a period of time sufficient to stretch the plantar fascia and relieve or prevent plantar fasciitis.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the present invention is made with reference to the accompanying drawings. In the drawings.

DETAILED DESCRIPTION OF THE INVENTION

Figure 1:
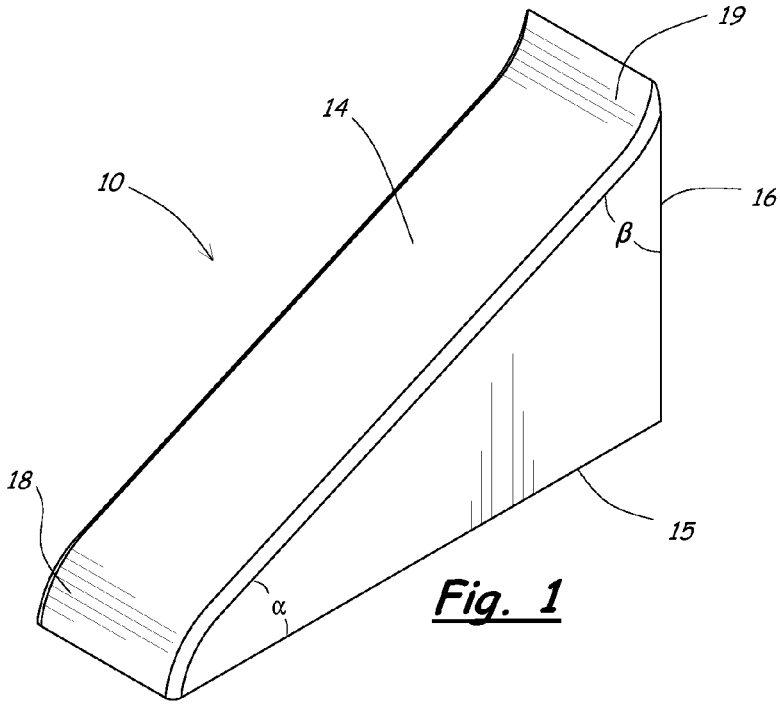
FIG. 1 is a perspective view of an apparatus for alleviating plantar fasciitis according to the present invention.
Figure 2:
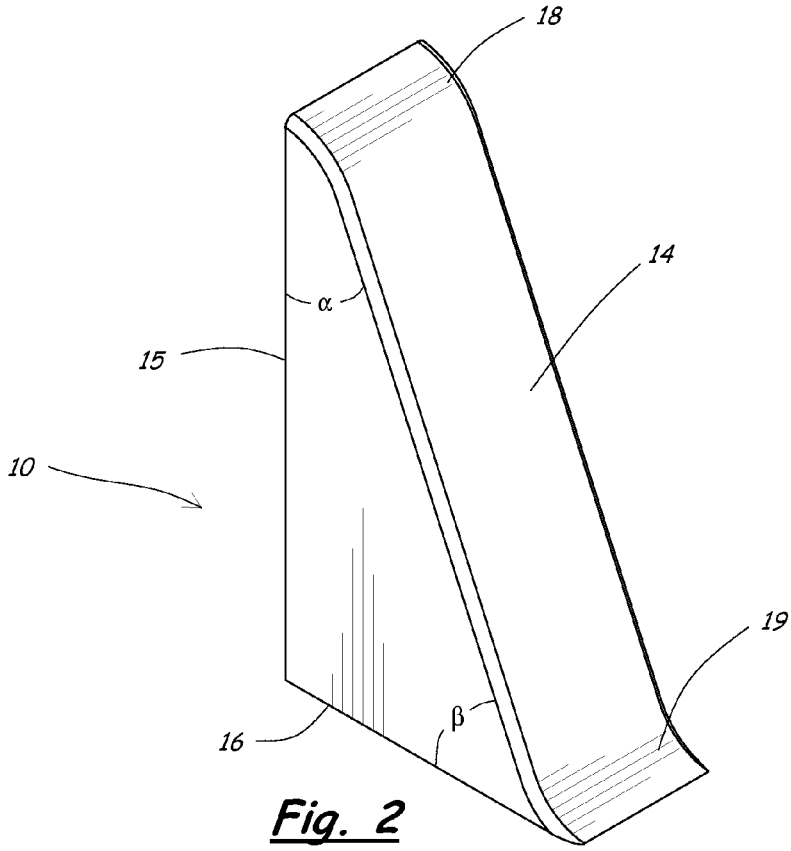
FIG. 2 is another perspective view of the apparatus shown in FIG. 1 for alleviating plantar fasciitis.

A device 10 for treating and preventing plantar fasciitis according to the present invention will now be described in detail with reference to FIGS. 1 to 6 of the accompanying drawings.

The device 10 is a solid wedge-shaped member that has no moving parts or straps. The wedge 10 is adapted to be placed under the phalanges of a user's big toe 11 with the other toes 12 falling to the floor 13 on the side of the wedge 10. The wedge 10 has a top surface 14 on which the big toe 11 rests during use, a first support surface 15 separated from the top surface 14 by a first angle α, and a second support surface 16 separated from the top surface by a second angle β. The first and second support surfaces 15, 16 are perpendicular with each other so that while one rests on the floor 13, the other serves as a backstop for engaging a stationary object 17 during use.

The top surface 14 is substantially flat and has a first rounded portion 18 adjacent to the first support surface 15, and a second rounded portion 19 adjacent to the second support surface 16. The first rounded portion 18 is a convex portion that extends across a width of the top surface 14 adjacent to the first support surface 15. The first rounded portion 18 preferably has a radius of curvature within a range of approximately 0.5 to 1.0 inch. The second rounded portion 19 is a concave portion that extends across a width of the top surface 14 adjacent to the second support surface 16. The second rounded portion 19 preferably has a radius of curvature within a range of approximately 0.5 to 1.0 inch.

In an example embodiment, the first support surface 15 is approximately five inches long, the second support surface 16 is approximately three inches long, and the device 10 is approximately 1.5 inches wide. The device 10 can be made of a solid piece of plastic or wood, for example.

Figure 3:
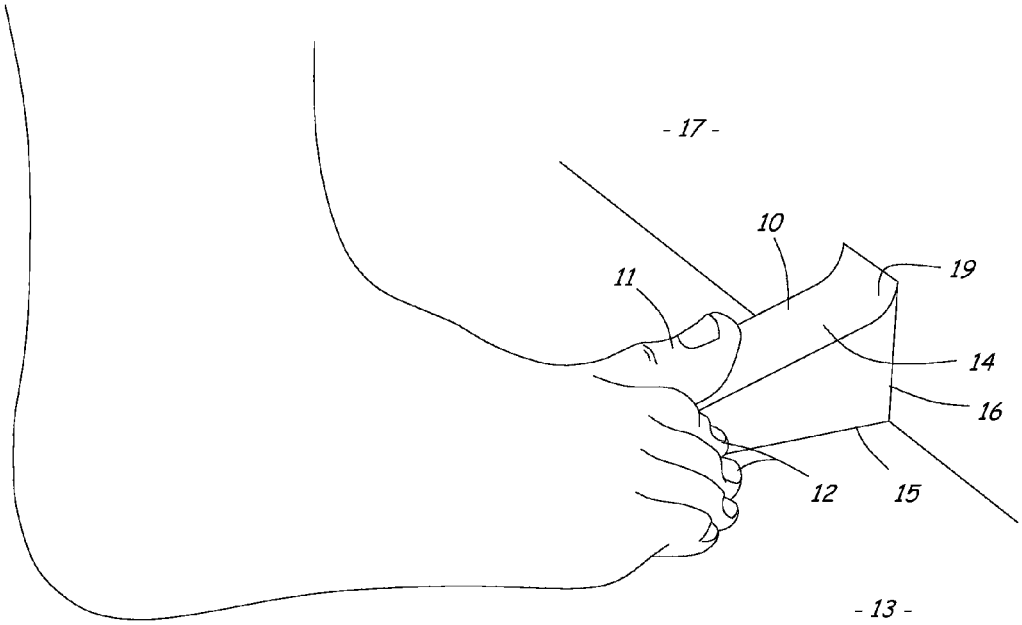
FIG. 3 is a perspective view of the apparatus of the present invention being used in a first treatment position to provide moderate stretching of a user's big toe.
Figure 4:
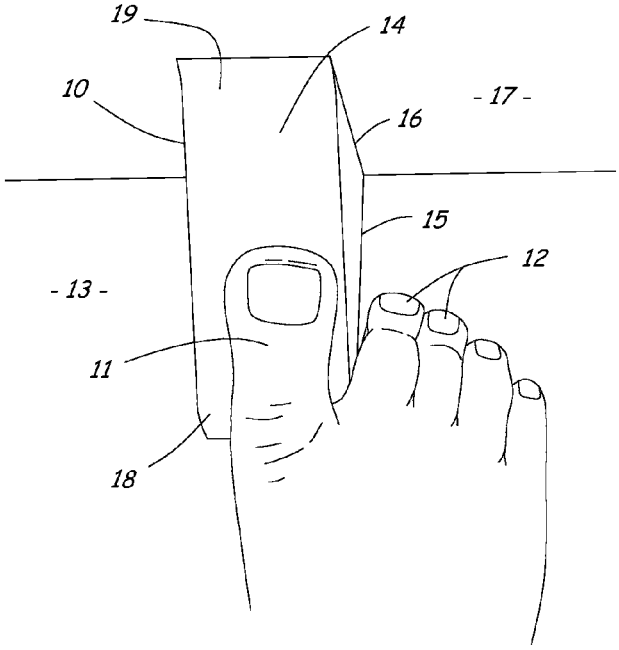
FIG. 4 is another perspective view of the apparatus being used in the first treatment position shown in FIG. 3.

The wedge 10 has a first position of use shown in FIGS. 3 and 4 in which the first support surface 15 faces downwardly and is placed on the floor 13, and the second support surface 16 is placed against a stationary object 17 (e.g., a vertical wall) to serve as a backstop. In the first position of use, the top surface 14 is inclined upwardly at the first angle α to provide moderate stretching of the plantar fascia. In a preferred embodiment, the first angle α is within a range of approximately 20 to 25 degrees.

Figure 5:
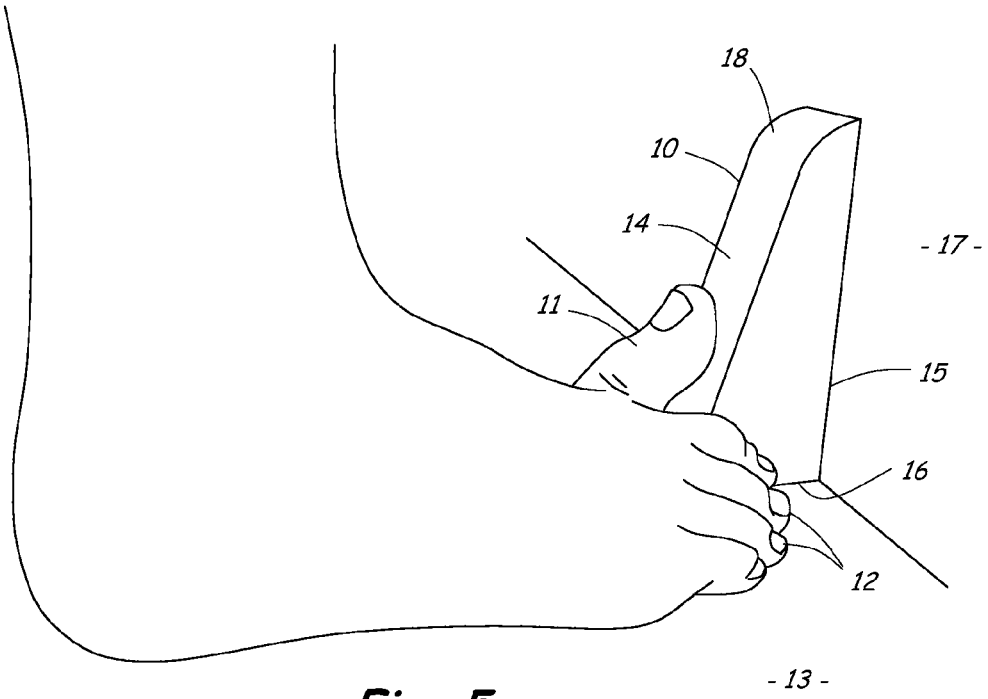
FIG. 5 is a perspective view of the apparatus of the present invention being used in a second treatment position to provide maximum stretching of a user's big toe.
Figure 6:
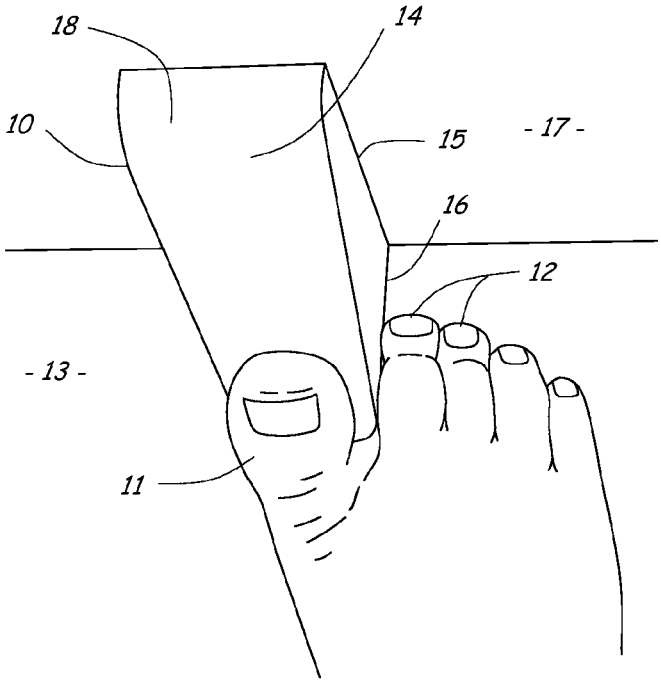
FIG. 6 is another perspective view of the apparatus being used in the second treatment position shown in FIG. 5.

The wedge 10 has a second position of use shown in FIGS. 5 and 6 in which the second support surface 16 faces downwardly and is placed on the floor 13, and the first support surface 15 is placed against the stationary object 17 to serve as a backstop. In the second position of use, the top surface 14 is inclined upwardly at the second angle β to provide maximum stretching of the plantar fascia. In the preferred embodiment, the second angle β is within a range of approximately 65 to 70 degrees, and preferably about 67 to 68 degrees. This steep angle β has been discovered to provide significantly better and more effective stretching of the plantar fascia for treating and preventing plantar fasciitis.

The device 10 for treating and preventing plantar fasciitis according to the present invention has been described above. A method of using the device 10 will now be described.

The method includes placing the wedge 10 on the floor 13 with either the first or the second support surface 15, 16 facing downwardly and engaging the floor 13, and the other support surface 15, 16 engaging a stationary object 17 as a backstop. The user's big toe 11 is placed against the top surface 14 of the wedge 10 while lifting the user's foot slightly above the floor 13. The user's foot is then lowered while sliding the big toe 11 down the top surface 14 of the wedge 10 until the foot is resting on the floor 13 from about the ball of the foot back to the heel. In this position, the proximal phalanx of the big toe 11 is inclined relative to the first metatarsal thereof at approximately the same angle as the top surface 14 of the wedge 10 relative to the floor 13. The foot is held in this position with the big toe 11 inclined by the wedge 10 for a period of time sufficient to stretch the plantar fascia and relieve the symptoms associated with plantar fasciitis.

If the plantar fascia of the user's foot is too tight initially to use the wedge 10 in the treatment position for maximum stretching (FIGS. 5 and 6), the wedge 10 can be used first in the position for moderate stretching (FIGS. 3 and 4). Once the plantar fascia has been moderately stretched by the wedge in the first treatment position (FIGS. 3 and 4), the wedge 10 can be repositioned in the second treatment position (FIGS. 5 and 6) with the top surface 14 in the steep angle of inclination. By using the multiple treatment positions described herein, the user can receive a good moderate stretch of the plantar fascia first, and eventually work up to the optimal maximum stretch of the plantar fascia for the most effective treatment.

When the wedge 10 is used in the treatment position for moderate stretching of the plantar fascia shown in FIGS. 3 and 4, the convex rounded portion 18 is located under the big toe 11 near the base of the proximal phalanges. The convex rounded portion 18 allows the phalanges of the big toe 11 to assume a slightly curled under position during moderate stretching (i.e., the distal phalange is angled slightly downward relative to the proximal phalange). The convex rounded portion 18 thus relieves some of the stress on the plantar fascia during the moderate stretching to make it easier for the user to work up to the optimal maximum stretching.

When the wedge 10 is used in the treatment position for maximum stretching of the plantar fascia shown in FIGS. 5 and 6, the concave rounded portion 19 is located under the big toe near the base of the proximal phalanges. The concave rounded portion 19 conforms to the inclined bottom surface of the user's big toe 11 and also causes the distal phalange of the big toe 11 to assume a steeper angle of inclination relative to the proximal phalange. This enhances the comfort and also improves the stretching action on the plantar fascia during the maximum stretching treatment.

An example treatment regime for the device 10 is to keep each foot in place with the big toe 11 inclined by the wedge 10 for approximately 30 seconds each time the device 10 is used. The device 10 can be used to stretch the plantar fascia of each foot first thing in the morning (e.g., as soon as the user gets out of bed before placing much weight on the foot). The device 10 can then be used to stretch later in the day (e.g., after the user has been on his or her feet all day, or just before going to bed). For runners, the device 10 can also be used to stretch each foot before and after each run.

The device 10 is compact and can be stored easily in a drawer or other small place out of the way when it is not being used. The device 10 can also be packed and taken during travel with little effort or inconvenience. The device 10 is durable, inexpensive to manufacture, has a long life expectancy, and is easy to use with no complicated set up required. The device 10 does not attach to the user's foot or footwear, and therefore is more versatile and adaptable to the user's normal routine than other prior art methods that require modification of the user's footwear or treatment while the user is walking or running.

While the invention has been specifically described in connection with specific embodiments thereof, it is to be understood that this is by way of illustration and not of limitation, and the scope of the appended claims should be construed as broadly as the prior art will permit.

What is claimed is:

1. A method of treating and preventing plantar fasciitis, comprising:

providing a wedge having a top surface, a first support surface separated from the top surface by a first angle, and a second support surface separated from the top surface by a second angle, said second support surface being perpendicular to said first support surface;

placing the wedge on a floor with the first support surface facing downwardly and resting on the floor and the second support surface engaging a stationary object;

placing a user's big toe against the top surface while lifting the user's foot slightly above the floor;

lowering the user's foot while sliding the big toe down the top surface of the wedge until the foot is resting on the floor from about the ball of the foot back to the heel; and holding the foot in position with the big toe inclined by the wedge for a period of time sufficient to stretch the plantar fascia and relieve or prevent plantar fasciitis.

2. The method according to claim 1, further comprising placing the wedge in a first treatment position to incline the big toe upwardly at a shallow angle with the second support surface engaging the stationary object and the first support surface facing downwardly and resting on the floor, and after using the wedge in said first treatment position to provide moderate stretching of the plantar fascia, then placing the wedge in a second treatment position to incline the big toe upwardly at a steep angle to provide maximum stretching of the plantar fascia with the first support surface engaging the stationary object and the second support surface facing downwardly and resting on the floor.

3. The method according to claim 2, wherein said shallow angle is approximately 20 to 25 degrees, and said steep angle is approximately 65 to 70 degrees.

4. The method according to claim 1, wherein said wedge is used to stretch the plantar fascia without attaching the wedge to the user's toe or the user's footwear.

5. The method according to claim 2, wherein said top surface of the wedge has a convex rounded portion that extends across a width of the top surface adjacent to the first support surface, and a concave rounded portion that extends across a width of the top surface adjacent to the second support surface;

locating the convex rounded portion under the big toe near the base of the proximal phalanges when the wedge is used in its first treatment position for moderate stretching of the plantar fascia; and locating the concave rounded portion under the big toe near the base of the proximal phalanges when the wedge is used in its second treatment position for maximum stretching of the plantar fascia.

* * * * *